US007231344B2

(12) United States Patent
Chu

(10) Patent No.: US 7,231,344 B2
(45) Date of Patent: Jun. 12, 2007

(54) METHOD AND APPARATUS FOR GRADIENT-DESCENT BASED WINDOW OPTIMIZATION FOR LINEAR PREDICTION ANALYSIS

(75) Inventor: Wai C. Chu, San Jose, CA (US)

(73) Assignee: NTT DoCoMo, Inc., Tokyo (JP)

( * ) Notice: Subject to any disclaimer, the term of this patent is extended or adjusted under 35 U.S.C. 154(b) by 759 days.

(21) Appl. No.: 10/282,966

(22) Filed: Oct. 29, 2002

(65) Prior Publication Data

US 2004/0083096 A1 Apr. 29, 2004

(51) Int. Cl.
*G10L 19/00* (2006.01)
*G10L 19/14* (2006.01)

(52) U.S. Cl. ..... 704/219; 704/211

(58) Field of Classification Search ..... None
See application file for complete search history.

(56) References Cited

U.S. PATENT DOCUMENTS 4,401,855 A * 8/1983 Broderson et al. ..... 704/219
5,048,088 A * 9/1991 Taguchi ..... 704/219
5,384,811 A * 1/1995 Dickopp et al. ..... 704/203

OTHER PUBLICATIONS

Prandoni et al., "R/D Optimal Linear Prediction", IEEE Transactions on Speech and Audio Processing, vol. 8, No. 6, Nov. 2000.*
Duda et al., "Pattern Classification", 2nd. New York: John Wiley & Sons, Inc., 2001.*
Clarkson et al., "Analysis of the Variance Threshold of Kay's Weighted Linear Predictor Frequency Estimator", IEEE Transactions on Signal Processing, vol. 42, No. 9, Sep. 1994.*
K.I. Siddiqui, Prof. Dr. N.M. Sheikh, H. Raza, and M.A. Farooq Alam, Bahauddin, "Real-Time Implementation of ITU-T's G.723.1 Dual Rate Speech Coder for Multimedia Communications Transmitting at 5.3 and 6.3 kbits/s on Trimedia's TM-1000 VLIW DSP CPU", *Proc. of IEEE 4th International Multitopics Conference Dec. 2001*, Lahore, Pakistan.
Fu-Kun Chen, Jar-Ferr Yang, and Yu-Pin Lin, Complexity Scalability for ACELP and MP-MLQ Speech Coders, *IEICE Trans Inf. & Syst.* vol. E85-D, No. Jan. 2002, pp. 255-263.

(Continued)

*Primary Examiner*—David Hudspeth
*Assistant Examiner*—Brian Albertalli
(74) *Attorney, Agent, or Firm*—Blakely, Sokoloff, Taylor & Zafman LLP

(57) ABSTRACT

The shape of windows used during linear predictive analysis can be optimized through the use of gradient-descent based window optimization procedures. Window optimization may be achieved fairly precisely through the use of a primary optimization procedure, or less precisely through the use of an alternate optimization procedure. Both optimization procedures use the principle of gradient-descent to find a window sequence that will either minimize the prediction error energy or maximize the segmental prediction gain. However, the primary optimization procedure uses a Levinson-Durbin based algorithm to determine the gradient while the alternate optimization procedure uses an estimate of the gradient based on the basic definition of a derivative. These optimization procedures can be implemented as computer readable software code. Additionally, the optimization procedures may be implemented in a window optimization device which generally includes a window optimization unit and may also include an interface unit.

44 Claims, 12 Drawing Sheets

OTHER PUBLICATIONS

International Telecommunication Union, "Dual Rate Speech Coder For Multimedia Communications Transmitting at 5.3 and 6.3 kbits/s", *ITU-T Recommendation G.723*, Mar. 1996.

"Implementing the Levinson-Durbin Algorithm on the SC140" by Corneliu Margina and Bogdan Costinescu, AN2197/D, Rev 0, Nov. 2001.

* cited by examiner

| Length | Rectangular window | | | | Optimized window | | | |
|---|---|---|---|---|---|---|---|---|
| | Training | | Testing | | Training | | Testing | |
| | SPG | PEP | SPG | PEP | SPG | PEP | SPG | PEP |
| 120 | 8.968 | 24359 | 8.800 | 25953 | 9.563 (+6.64%) | 22198 (-8.87%) | 9.400 (+6.82%) | 22879 (-11.8%) |
| 140 | 8.963 | 24156 | 8.845 | 25767 | 9.507 (+6.07%) | 22297 (-7.70%) | 9.408 (+6.38%) | 23249 (-9.77%) |
| 160 | 8.952 | 24094 | 8.871 | 25319 | 9.455 (+5.62%) | 22459 (-6.79%) | 9.338 (+5.27%) | 23304 (-7.96%) |
| 200 | 8.932 | 24131 | 8.823 | 25972 | 9.372 (+4.93%) | 22769 (-5.64%) | 9.284 (+5.22%) | 23874 (-8.08%) |
| 240 | 8.947 | 24198 | 8.845 | 25975 | 9.333 (+4.32%) | 23092 (-4.57%) | 9.186 (+3.85%) | 24254 (-6.63%) |
| 300 | 8.923 | 24604 | 8.799 | 26341 | 9.241 (+3.57%) | 23608 (-4.05%) | 9.128 (+3.74%) | 25019 (-5.02%) |

FIG. 12

METHOD AND APPARATUS FOR GRADIENT-DESCENT BASED WINDOW OPTIMIZATION FOR LINEAR PREDICTION ANALYSIS

BACKGROUND

Speech analysis involves obtaining characteristics of a speech signal for use in speech-enabled applications, such as speech synthesis, speech recognition, speaker verification and identification, and enhancement of speech signal quality. Speech analysis is particularly important to speech coding systems.

Speech coding refers to the techniques and methodologies for efficient digital representation of speech and is generally divided into two types, waveform coding systems and model-based coding systems. Waveform coding systems are concerned with preserving the waveform of the original speech signal. One example of a waveform coding systems is the direct sampling system which directly samples a sound at high bit rates ("direct sampling systems"). Direct sampling systems are typically preferred when quality reproduction is especially important. However, direct sampling systems require a large bandwidth and memory capacity. A more efficient example of waveform coding is pulse code modulation.

In contrast, model-based speech coding systems are concerned with analyzing and representing the speech signal as the output of a model for speech production. This model is generally parametric and includes parameters that preserve the perceptual qualities and not necessarily the waveform of the speech signal. Known model-based speech coding systems use a mathematical model of the human speech production mechanism referred to as the source-filter model.

The source-filter model models a speech signal as the air flow generated from the lungs (an "excitation signal"), filtered with the resonances in the cavities of the vocal tract, such as the glottis, mouth, tongue, nasal cavities and lips (a "filter"). The excitation signal acts as an input signal to the filter similarly to the way the lungs produce air flow to the vocal tract. Model-based speech coding systems using the source-filter model, generally determine and code the parameters of the source-filter model. These model parameters generally include the parameters of the filter. The model parameters are determined for successive short time intervals or frames (e.g., 10 to 30 ms analysis frames), during which the model parameters are assumed to remain fixed or unchanged. However, it is also assumed that the parameters will change with each successive time interval to produce varying sounds.

The parameters of the model are generally determined through analysis of the original speech signal. Because the filter (the "analysis filter") generally includes a polynomial equation including several coefficients to represent the various shapes of the vocal tract, determining the parameters of the filter generally includes determining the coefficients of the polynomial equation (the "filter coefficients"). Once the filter coefficients have been obtained, the excitation signal can be determined by filtering the original speech signal with a second filter that is the inverse of the filter.

One method for determining the coefficients of the filter is through the use of linear predictive analysis ("LPA") techniques. LPA is a time-domain technique based on the concept that during a successive short time interval or frame "N," each sample of a speech signal ("speech signal sample" or "s[n]") is predictable through a linear combination of samples from the past s[n−k] together with the excitation signal u[n].

$$s[n] = \sum_{k=1}^{M} a_k s[n-k] + Gu[n] \tag{1}$$

where G is a gain term representing the loudness over the frame (about 10 ms), M is the order of the polynomial (the "prediction order"), and $a_k$ are the filter coefficients which are also referred to as the "LP coefficients." The analysis filter is therefore a function of the past speech samples s[n] and is represented in the z-domain by the formula:

$$H[z]=G/A[z] \tag{2}$$

A[z] is an M order polynomial given by:

$$A[z] = 1 + \sum_{k=1}^{M} a_k z^{-k} \tag{3}$$

The order of the polynomial A[z] can vary depending on the particular application, but a 10th order polynomial is commonly used with an 8 kHz sampling rate.

The LP coefficients $a_1 \ldots a_M$ are computed by analyzing the actual speech signal s[n]. The LP coefficients are approximated as the coefficients of a filter used to reproduce s[n] (the "synthesis filter"). The synthesis filter uses the same LP coefficients as the analysis filter and produces a synthesized version of the speech signal. The synthesized version of the speech signal may be estimated by a predicted value of the speech signal $\tilde{s}[n]$. $\tilde{s}[n]$ is defined according to the formula:

$$\tilde{s}[n] = -\sum_{k=1}^{M} a_k s[n-k] \tag{4}$$

Because s[n] and s[n] are not exactly the same, there will be an error associated with the predicted speech signal s[n] for each sample n referred to as the prediction error $e_p[n]$, which is defined by the equation:

$$e_p[n] = s[n] - \tilde{s}[n] = s[n] + \sum_{k=1}^{M} a_k s[n-k] \tag{5}$$

where the sum of all the prediction errors defines the total prediction error $E_p$:

$$E_p=\Sigma e_p^2[k] \tag{6}$$

where the sum is taken over the entire speech signal. The LP coefficients $a_1 \ldots a_M$ are generally determined so that the total prediction error $E_p$ is minimized (the "optimum LP coefficients").

One common method for determining the optimum LP coefficients is the autocorrelation method. The basic procedure consists of signal windowing, autocorrelation calculation, and solving the normal equation leading to the optimum LP coefficients. Windowing consists of breaking down the speech signal into frames or intervals that are sufficiently small so that it is reasonable to assume that the optimum LP coefficients will remain constant throughout each frame. During analysis, the optimum LP coefficients are determined for each frame. These frames are known as the analysis intervals. The LP coefficients obtained through analysis are then used for synthesis or prediction inside frames known as synthesis intervals. In practice, the analysis and synthesis intervals might not be the same.

When windowing is used, assuming for simplicity a rectangular window sequence of unity height including window samples w[n], the total prediction error Ep in a given frame or interval may be expressed as:

$$E_p = \sum_{k=n_1}^{n_2} e_p^2[k] \tag{7}$$

where n1 and n2 are the indexes corresponding to the beginning and ending samples of the window sequence and define the synthesis frame.

Once the speech signal samples s[n] are isolated into frames, the optimum LP coefficients can be found using an autocorrelation method. To minimize the total prediction error, the values chosen for the LP coefficients must cause the derivative of the total prediction error with respect to each LP coefficients to equal or approach zero. Therefore, the partial derivative of the total prediction error is taken with respect to each of the LP coefficients, producing a set of M equations. Fortunately, these equations can be used to relate the minimum total prediction error to an autocorrelation function:

$$E_p = R_p[0] - \sum_{k=1}^{M} a_i R_p[k] \tag{8}$$

where M is the prediction order and $R_p(k)$ is an autocorrelation function for a given time-lag l which is expressed by:

$$R[l] = \sum_{k=1}^{N-1} w[k]s[k]w[k-l]s[k-l] \tag{9}$$

where s[k] are speech signal sample, w[k] are the window samples that together form a plurality of window sequences each of length N (in number of samples) and s[k−l] and w[k−l] are the input signal samples and the window samples lagged by l. It is assumed that w[n] may be greater than zero only from k=0 to N−1.

Because the minimum total prediction error can be expressed as an equation in the form Ra=b (assuming that $R_p[\mathbf{0}]$ is separately calculated), the Levinson-Durbin algorithm may be used to determine for the optimum LP coefficients.

Many factors affect the minimum total prediction error that can be achieved including the shape of the window in the time domain. Generally, the window sequences adopted by coding standards have a shape that includes tapered-ends so that the amplitudes are low at the beginning and end of the window sequences with a peak amplitude located in-between. These windows are described by simple formulas and their selection inspired by the application in which they will be used. Generally, known methods for choosing the shape of the window are heuristic. There is no deterministic method for determining the optimum window shape.

BRIEF SUMMARY

The shape of the window sequences used during LP analysis can be optimized through the use of window optimization procedures which are based on the principle of gradient-descent. Two optimization procedures are described here, a "primary optimization procedure" and an "alternate optimization procedure", which rely on the principle of gradient-descent to find a window sequence that will either minimize the prediction error energy or maximize the segmental prediction gain. Although both optimization procedures involve determining a gradient, the primary optimization procedure uses a Levinson-Durbin based algorithm to determine the gradient while the alternate optimization procedure uses an estimate based on the basic definition of a partial derivative.

These optimization procedures can be implemented as computer readable software code which may be stored on a processor, a memory device or on any other computer readable storage medium. Alternatively, the software code may be encoded in a computer readable electronic or optical signal. Additionally, the optimization procedures may be implemented in a window optimization device which generally includes a window optimization unit and may also include an interface unit. The optimization unit includes a processor coupled to a memory device. The processor performs the optimization procedures and obtains the relevant information stored on the memory device. The interface unit generally includes an input device and an output device, which both serve to provide communication between the window optimization unit and other devices or people.

BRIEF DESCRIPTION OF SEVERAL VIEWS OF THE DRAWINGS

This disclosure may be better understood with reference to the following figures and detailed description. The components in the figures are not necessarily to scale, emphasis being placed upon illustrating the relevant principles. Moreover, like reference numerals in the figures designate corresponding parts throughout the different views.

FIG. 12 is table summarizing the segmental prediction gain and the prediction error power determined for window sequences of various window lengths before and after the application of an optimization procedure, obtained through experiments according to a preferred embodiment of the present invention.

DETAILED DESCRIPTION

Figure 1:
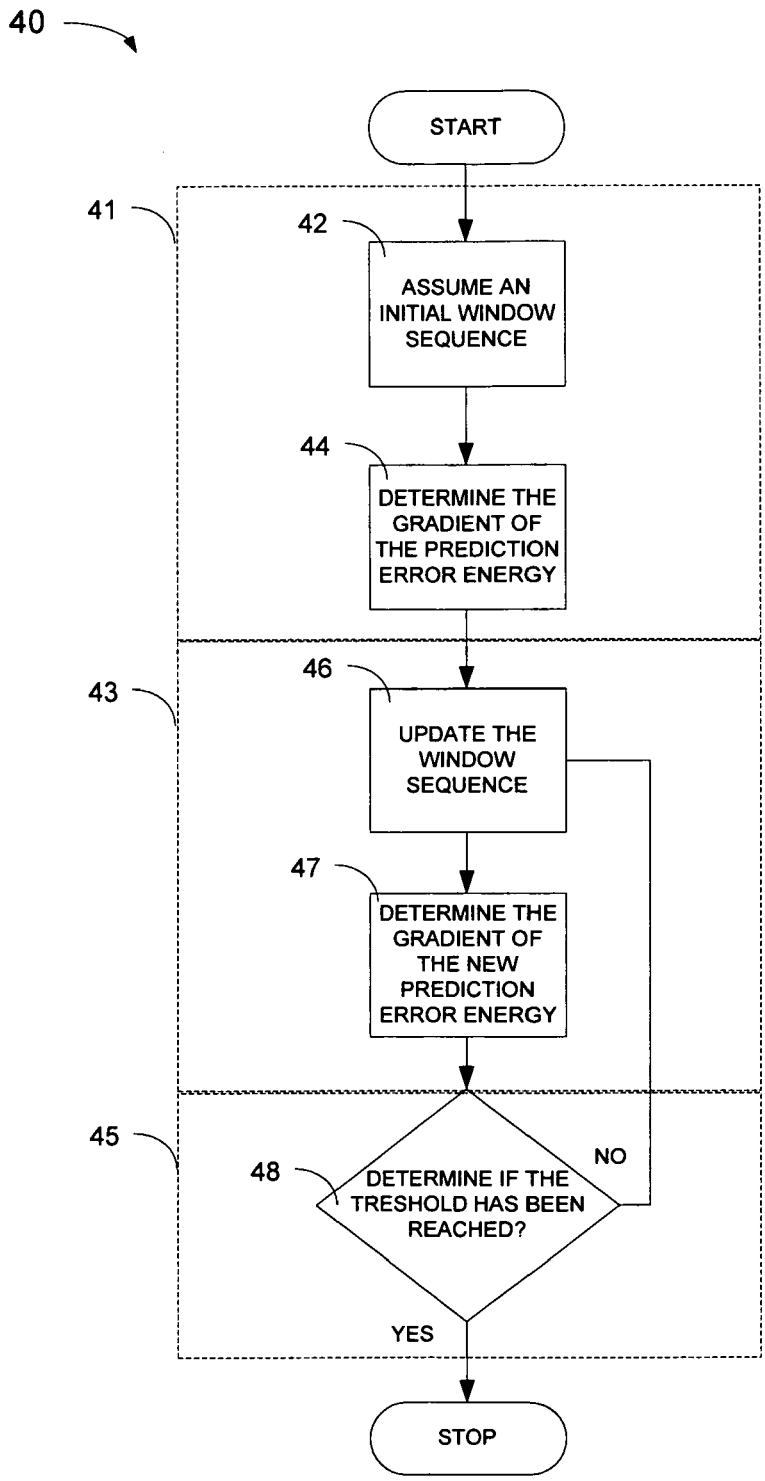
FIG. 1 is a flow chart of a primary optimization procedure according to a preferred embodiment of the present invention.

The shape of the window used during LP analysis can be optimized through the use of window optimization procedures which rely on gradient-descent based methods ("gradient-descent based window optimization procedures" or hereinafter "optimization procedures"). Window optimization may be achieved fairly precisely through the use of a primary optimization procedure, or less precisely through the use of an alternate optimization procedure. The primary optimization and the alternate optimization procedures are both based on finding the window sequence that will either minimize the prediction error energy ("PEEN") or maximize the prediction gain ("PG"). Additionally, although both the primary optimization procedure and the alternate optimization procedure involve determining a gradient, the primary optimization procedure uses a Levinson-Durbin based algorithm to determine the gradient while the alternate optimization procedure uses the basic definition of a partial derivative to estimate the gradient. Improvements in LP analysis obtained by using the window optimization procedures is demonstrated by experimental data that compares the time-averaged PEEN (the "prediction-error power" or "PEP") and the time-averaged PE (the "segmental prediction gain" or "SPG") obtained using window segments that were not optimized at all to the PEP and SPG obtained using window segments that were optimized using the optimization procedures.

The optimization procedures optimize the shape of the window sequence used during LP analysis by minimizing the PEEN or maximizing PG. The PG at the synthesis interval $n \in [n_1, n_2]$ is defined by the following equation:

$$PG = 10\log_{10}\left(\sum_{n=n_1}^{n_2}(s[n])^2 \Big/ \sum_{n=n_1}^{n_2}(e[n])^2\right), \tag{10}$$

wherein PG is the ratio in decibels ("dB") between the speech signal energy and prediction error energy. For the same synthesis interval $n \in [n_1, n_2]$, the PEEN is defined by the following equation:

$$J = \sum_{n=n_1}^{n_2}(e[n])^2 = \sum_{n=n_1}^{n_2}(s[n]-\hat{s}[n])^2 = \sum_{n=n_1}^{n_2}\left(s[n]+\sum_{i=1}^{M}a_i s[n-i]\right)^2 \tag{11}$$

wherein e[n] denotes the prediction error; s[n] and ŝ[n] denote the speech signal and the predicted speech signal, respectively; the coefficients $a_i$, for i=1 to M are the LP coefficients, with M being the prediction order. The minimum value of the PEEN, denoted by J, occurs when the derivatives of J with respect to the LP coefficients equal zero.

Because the PEEN can be considered a function of the N samples of the window, the gradient of J with respect to the window sequence can be determined from the partial derivatives of J with respect to each window sample:

$$\nabla J = \left[\frac{\partial J}{\partial w[0]}\ \frac{\partial J}{\partial w[1]}\ \cdots\ \frac{\partial J}{\partial w[N-1]}\right]^T, \tag{12}$$

where T is the transpose operator. By finding the gradient of J, it is possible to adjust the window sequence in the direction negative to the gradient so as to reduce the PEEN. This is the principle of gradient-descent. The window sequence can then be adjusted and the PEEN recalculated until a minimum or otherwise acceptable value of the PEEN is obtained.

Both the primary and alternate optimization procedures obtain the optimum window sequence by using LPA to analyze a set of speech signals and using the principle of gradient-descent. The set of speech signals $\{s_k[n], k=0, 1, \ldots, N_t-1\}$ used is known as the training data set which has size $N_t$, and where each $s_k[n]$ is a speech signal which is represented as an array containing speech samples. Generally, the primary and alternate optimization procedures include an initialization procedure, a gradient-descent procedure and a stop procedure. During the initialization procedure, an initial window sequence $w_m$ is chosen and the PEP of the whole training set is computed, the results of which are denoted as $PEP_0$. $PEP_0$ is computed using the initialization routine of a Levinson-Durbin algorithm. The initial window sequence includes a number of window samples, each denoted by w[n] and can be chosen arbitrarily.

During the gradient-descent procedure, the gradient of the PEEN is determined and the window sequence is updated. The gradient of the PEEN is determined with respect to the window sequence $w_m$, using the recursion routine of the Levinson-Durbin algorithm, and the speech signal $s_k$ for all speech signals ($k \leftarrow 0$ to $N_t-1$). The window sequence is updated as a function of the window sequence and a window update increment. The window update increment is generally defined prior to executing the optimization procedure.

The stop procedure includes determining if the threshold has been met. The threshold is also generally defined prior to using the optimization procedure and represents an amount of acceptable error. The value chosen to define the threshold is based on the desired accuracy. The threshold is met when the PEP for the whole training set $PEP_m$, determined using window sequence $w_m$ for the whole training set, has not decreased substantially with respect to the prior PEP, denoted as $PEP_{m-1}$ (if M=0 the $PEP_{m-1}=0$). Whether $PEP_m$ has decreased substantially with respect to $PEP_{m-1}$ is determined by subtracting $PEP_m$ from $PEP_{m-1}$ and comparing the resulting difference to the threshold. If the resulting difference is greater than the threshold, the gradient-descent procedure (including updating the window sequence so that $m \leftarrow m+1$) and the stop procedure are repeated until the difference is equal to or less than the threshold. The performance of the optimization procedure for each window sequence, up to and including reaching the threshold, is know as one epoch. In the following description, the subscript m denoting the window sequence to which each equation relates is omitted in places where the omission improves clarity.

The primary window optimization procedure is shown in FIG. 1 and indicated by reference number 40. This primary window optimization procedure 40 generally includes, applying an initialization procedure 41, a gradient-descent procedure 43, and a stop procedure 45. The initialization procedure includes, assuming an initial window sequence 42, and determining the gradient of the PEEN 44. The gradient-descent procedure 43 includes, updating the window sequence 46, and determining the gradient of the new PEEN 47. The stop procedure 45 includes determining if a threshold has been met 48, and if the threshold has not been met repeating the gradient-descent 43 and stop 45 procedures until the threshold is met.

Figure 2:
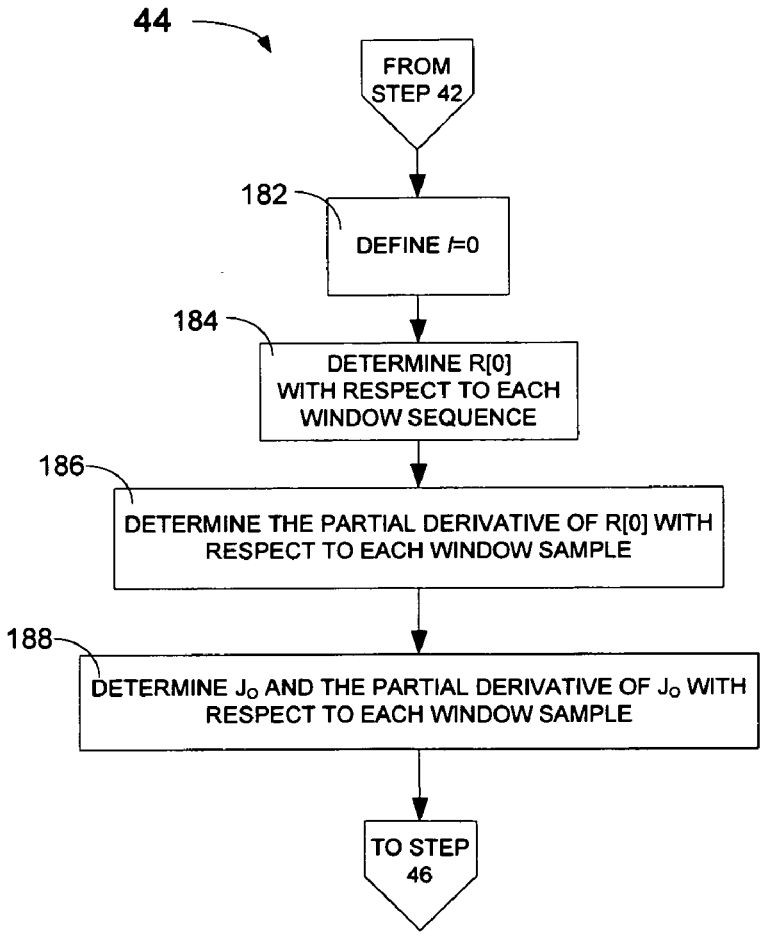
FIG. 2 is a flow chart of a procedure for determining a zero-order gradient, according to a preferred embodiment of the present invention.

During the initialization procedure 41, an initial window sequence is assumed 42 and the gradient of the PEEN is determined with respect to the initial window (the "initial PEEN"). Generally, the initial window sequence $w_o$ is defined as a rectangular window sequence but may be defined as any window sequence, such as a sequence with tapered ends. The step of determining the gradient of the initial PEEN 44 is shown in more detail in FIG. 2. Generally, the gradient of the initial PEEN is determined by the initialization procedure of the Levinson-Durbin algorithm and includes defining a time-lag l as zero 182, determining the autocorrelation value for l=0 with respect to each window sample (the "initial autocorrelation values" or "R[0]") 184, determining the partial derivative of the initial autocorrelation values, and determining the PEEN and the partial derivative of PEEN for l=0 with respect to each window sample ("$J_o$") 188.

Determining the initial autocorrelation values R[0] with respect to each window sample 184 includes determining the initial autocorrelation values as a function of the window sequence and the speech signal as defined by equation (9) for l=0. Once R[0] is determined, $J_o$ is determined as a function of R[0], wherein $J_o$=R[0]. The partial derivative of R[0] is then determined in step 186 from known values of the partial derivatives of R[l] which are defined by the following equation:

$$\frac{\partial R[l]}{\partial w[n]} = \begin{cases} w[n+l]s[n+l]s[n]; & 0 \le n < l \\ w[n-l]s[n-l]s[n]; & N-l \le n < N \\ s[n](w[n-l]s[n-l] + w[n+l]s[n+l]); & \text{otherwise} \end{cases} \tag{13}$$

In step 188 the PEEN and the partial derivative of PEEN $J_o$ with respect to each window sample can be determined from the relationships between $J_o$ and R[0] and between the partial derivative of $J_o$ and the partial derivative of R[0], respectively, as defined in the Levinson-Durbin algorithm (the "zero-order predictor"):

$$J_o = R[0] \tag{14a}$$

$$\frac{\partial J_0}{\partial w[n]} = \frac{\partial R[0]}{\partial w[n]}; n = 0, \ldots, N-1. \tag{14b}$$

Referring now to FIG. 1, during the gradient-descent procedure 43, the window sequence is updated in step 46 and the gradient of the PEEN determined with respect to the window sequence (the "new PEEN") 47. The window sequence is updated as a function of a window update increment, which is referred to as a step size parameter μ:

$$w_m[n] \leftarrow w_m[n] - \mu \cdot \frac{\partial J}{\partial w_m[n]}; n = 0, \ldots, N-1 \tag{15}$$

Figure 3:
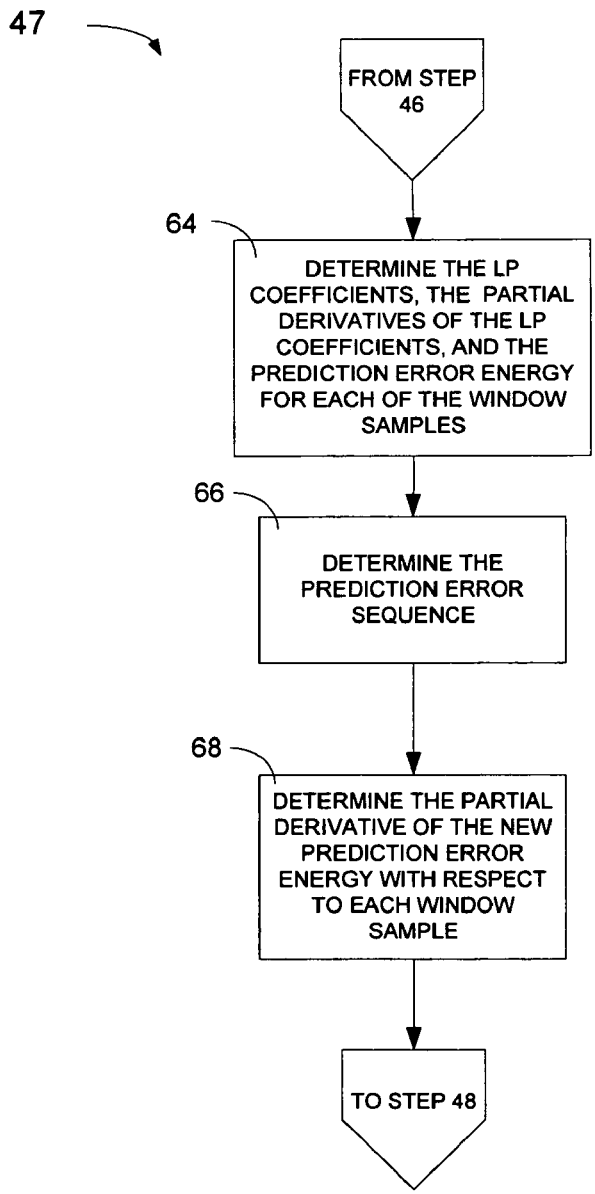
FIG. 3 is a flow chart of a procedure for determining an l-order gradient, according to a preferred embodiment of the present invention.

The step of determining the gradient of the new PEEN 47 is shown in more detail in FIG. 3. Determining the gradient of new PEEN 47 includes determining the LP coefficients and the partial derivatives of the LP coefficients for each window sample 64, determining the prediction error sequence e[n] 66, and determining PEEN and the partial derivatives of PEEN with respect to each window sample 68.

Figure 4:
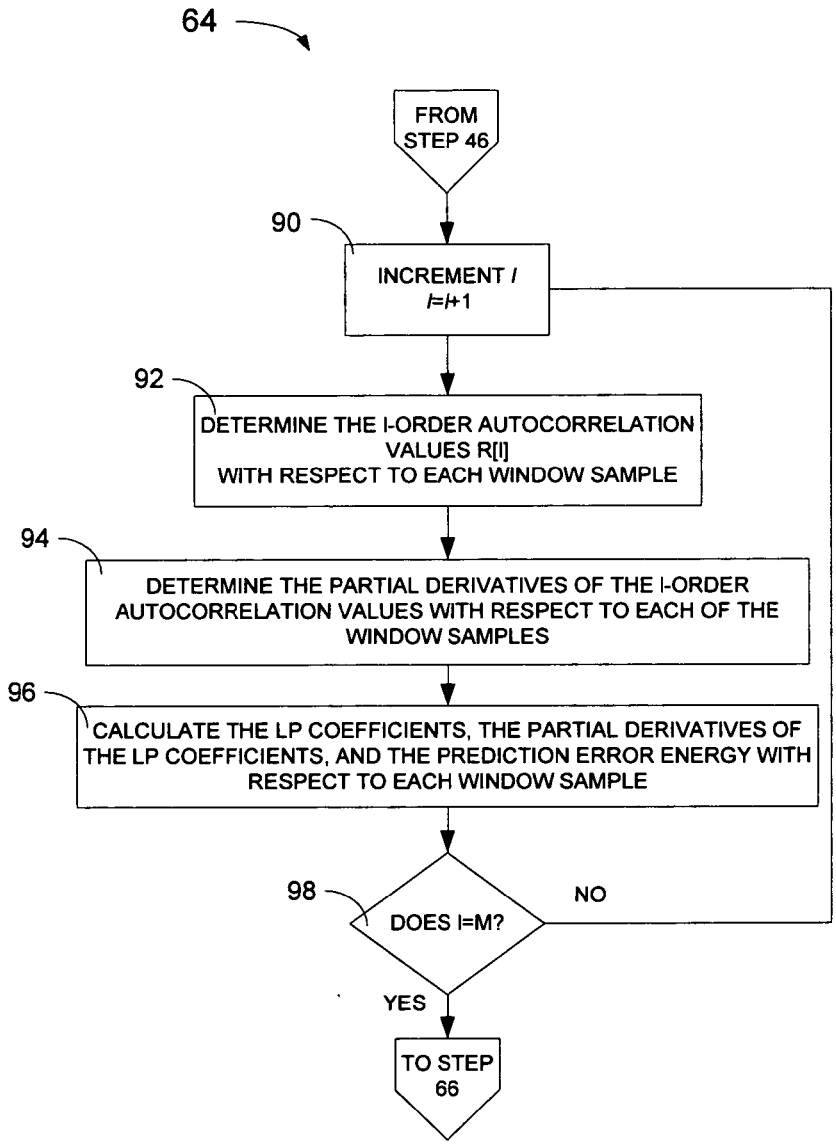
FIG. 4 is a flow chart of a procedure for determining the LP coefficients and the partial derivative of the LP coefficients, according to a preferred embodiment of the present invention.

The step of determining the LP coefficients and the partial derivatives of the LP coefficients 64 is shown in more detail in FIG. 4. The LP coefficients and the partial derivatives of the LP coefficients are determined using a method based on the recursion routine of the Levinson-Durbin algorithm which includes incrementing l so that l=l+1 90, determining the l-order autocorrelation values R[l] with respect to each window sample 92, determining the partial derivatives of the l-order autocorrelation values with respect to each the window sample 94, determining the LP coefficients and the partial derivatives of the LP coefficients with respect to each window sample 96, determining whether l equals the prediction order M 98 and repeating steps 90 through 98 until l does equal M.

After l is incremented in step 90, the l-order autocorrelation values are determined using equation (9) for each window sample (denoted in equation (9) by the index variable k). Then in step 92, the partial derivatives of the l-order autocorrelation values are determined from the known values defined in equation (13).

The step of determining the LP coefficients $a_i$ and the partial derivatives of the LP coefficients with respect to each window sample $$\frac{\partial a_i}{\partial w[n]}$$

Figure 5:
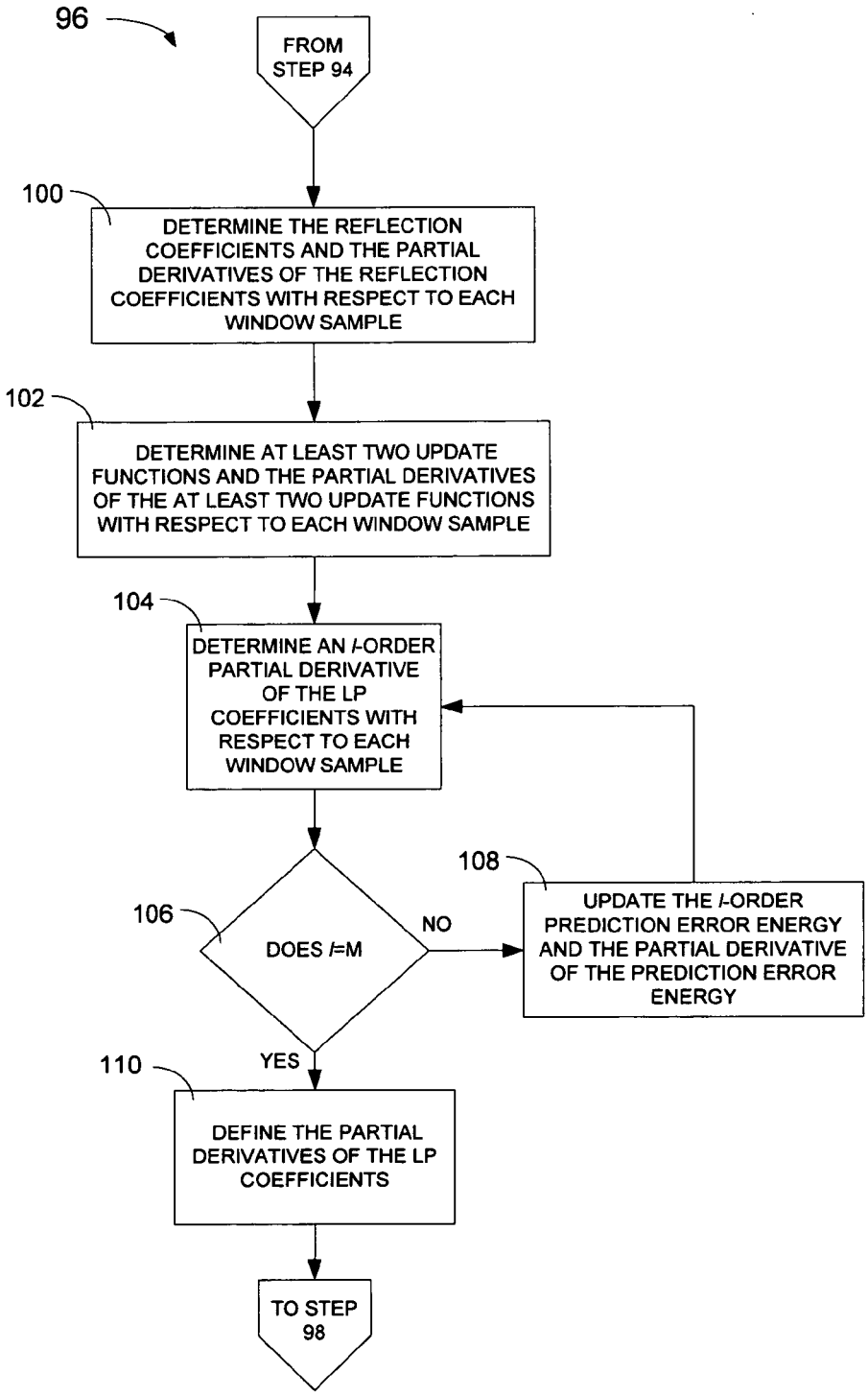
FIG. 5 is a flow chart of a procedure for calculating LP coefficients, the partial derivative of LP coefficients, according to a preferred embodiment of the present invention.

96, includes calculating the LP coefficients and the partial derivatives of the LP coefficients with respect to each window sample as a function of the zero-order predictors determined in equations (14a) and (14b), respectively, and the reflection coefficients and the partial derivatives of reflection coefficients, respectively, and is shown in more detail in FIG. 5. The step of calculating the LP coefficients and the partial derivatives of the LP coefficients 96 includes determining the reflection coefficients and the partial derivatives of reflection coefficients with respect to each window sample 100, determining an update function and a partial derivative of an update function with respect to each window sample 102, determining an l-order LP coefficient and the partial derivatives of the LP coefficients 104, determining if l=M 106, wherein if l does not equal M updating the l-order partial derivatives of the PEEN 108 and repeating steps 104 and 106 until l does equal M in step 106.

The reflection coefficients and the partial derivatives of reflection coefficients with respect to each window sample are determined in step 100 from equations:

$$k_i - \frac{1}{J_{l-1}}\left(R[l] + \sum_{i=1}^{l-1} a_i^{l-1} R[l-1]\right) \tag{16a}$$

$$\frac{\partial k_l}{\partial w[n]} = \frac{1}{J_{l-1}}\left(\frac{\partial R[l]}{\partial w[n]} - \frac{R[l]}{J_{l-1}}\frac{\partial J_{l-1}}{\partial w[n]} + \sum_{i=1}^{l-1} a_i^{(l-1)}\frac{\partial R[l-i]}{\partial w[n]} + R[l-i]\frac{\partial a_i^{(l-1)}}{\partial w[n]} - \frac{a_i^{(l-1)} R[l-i]}{J_{l-1}}\frac{\partial J_{l-1}}{\partial w[n]}\right), \tag{16b}$$

The update function and the partial derivative of the update function are then determined with respect to each window sample in step 102 by equations:

$$a_l^{(l)} = -k_l \tag{17a}$$

$$\frac{\partial a_l^{(l)}}{\partial w[n]} = -\frac{\partial k_l}{\partial w[n]}, \tag{17b}$$

The l-order LP coefficients and the partial derivatives of the l-order LP coefficients with respect to each window sample for i=1, 2, . . . , l−1 are determined in step 104. The l-order LP coefficients are determined by equations:

$$a_i^{(l)} = -k_l \tag{18a}$$

$$a_i^{(l)} = a_i^{(l-1)} - k_l a_{l-i}^{(l-1)} \tag{18b}$$

and the partial derivatives of the l-order LP coefficients are determined by equations:

$$\frac{\partial a_i^{(l)}}{\partial w[n]} = -\frac{\partial k_i}{\partial w[n]} \tag{18c}$$

$$\frac{\partial a_i^{(l)}}{\partial w[n]} = -\frac{\partial a_i^{(l-1)}}{\partial w[n]} - a_{l-i}^{(l-1)}\frac{\partial k_l}{\partial w[n]} - k_l\frac{\partial a_{l-i}^{(l-1)}}{\partial w[n]} \tag{18d}$$

So long as l does not equal M, the l-order PEEN and the l-order partial derivative of the PEEN are updated in step 108 by equations:

$$J_l = J_l - 1(1 - k_l^2) \tag{19a}$$

$$\frac{\partial J_l}{\partial w[n]} = (1 - k_l^2)\frac{\partial J_{l-1}}{\partial w[n]} - 2k_l J_{l-1}\frac{\partial k_l}{\partial w[n]}. \tag{19b}$$

Once l does equal M, the LP coefficients and the partial derivatives of the LP coefficients are defined by $a_i = a_i^{(M)}$ and $$\frac{\partial a_i}{\partial w[n]} = -\frac{\partial a_i^{(M)}}{\partial w[n]}$$

respectively, in step 110.

Referring now to FIG. 3, the prediction error sequence is determined in step 66 from the relationship among the prediction error sequence, the speech signal and the LP coefficients as defined in equation (11):

$$\sum_{n=n_1}^{n_2} (e[n]) = \sum_{n=n_1}^{n_2}\left(s[n] + \sum_{i=1}^{M} a_i s[n-i]\right) \tag{20}$$

Then, in step 68, the partial derivative of PEEN with respect to each window sample is determined by deriving the derivative of PEEN from the definition of PEEN given in equation (11) and solving for $$\frac{\partial J}{\partial w[n]}:$$

$$\frac{\partial J}{\partial w[n]} = \sum_{k=n_1}^{n_2} 2e[k]\frac{\partial e[k]}{\partial w[n]} = \sum_{k=n_1}^{n_2} 2e[k]\left(\sum_{i=1}^{M} s[k-i]\frac{\partial a_i}{\partial w[n]}\right) \tag{21}$$

Referring now to FIG. 1, a determination is made as to whether a threshold has been met in step 48. This includes comparing the derivative of the PEEN obtained for the current window sequence $w_m[n]$ with that of the previous window sequence $W_{m-1}[n]$ (if m=0, $w_{m-1}[n]=0$). If the difference between $w_m[n]$ and $w_{m-1}[n]$ is greater than a previously-defined threshold, the threshold has not been and met the window sequence is updated in step 46 according to equation (15), and steps 46, 47 and 48 are repeated until the difference between $w_m[n]$ and $w_{m-1}[n]$ is less than or equal to the threshold. If the difference between $w_m[n]$ and $w_{m-1}[n]$ is less than or equal to the threshold, the entire process, including steps 42 through 48, are repeated.

As applied to speech coding, linear prediction has evolved into a rather complex scheme where multiple transformation steps among the LP coefficients are common; some of these steps include bandwidth expansion, white noise correction, spectral smoothing, conversion to line spectral frequency, and interpolation. Under these and other circumstances, it is not feasible to find the gradient using the primary optimization procedure. Therefore, numerical method such as the alternate optimization procedure can be used.

Figure 6:
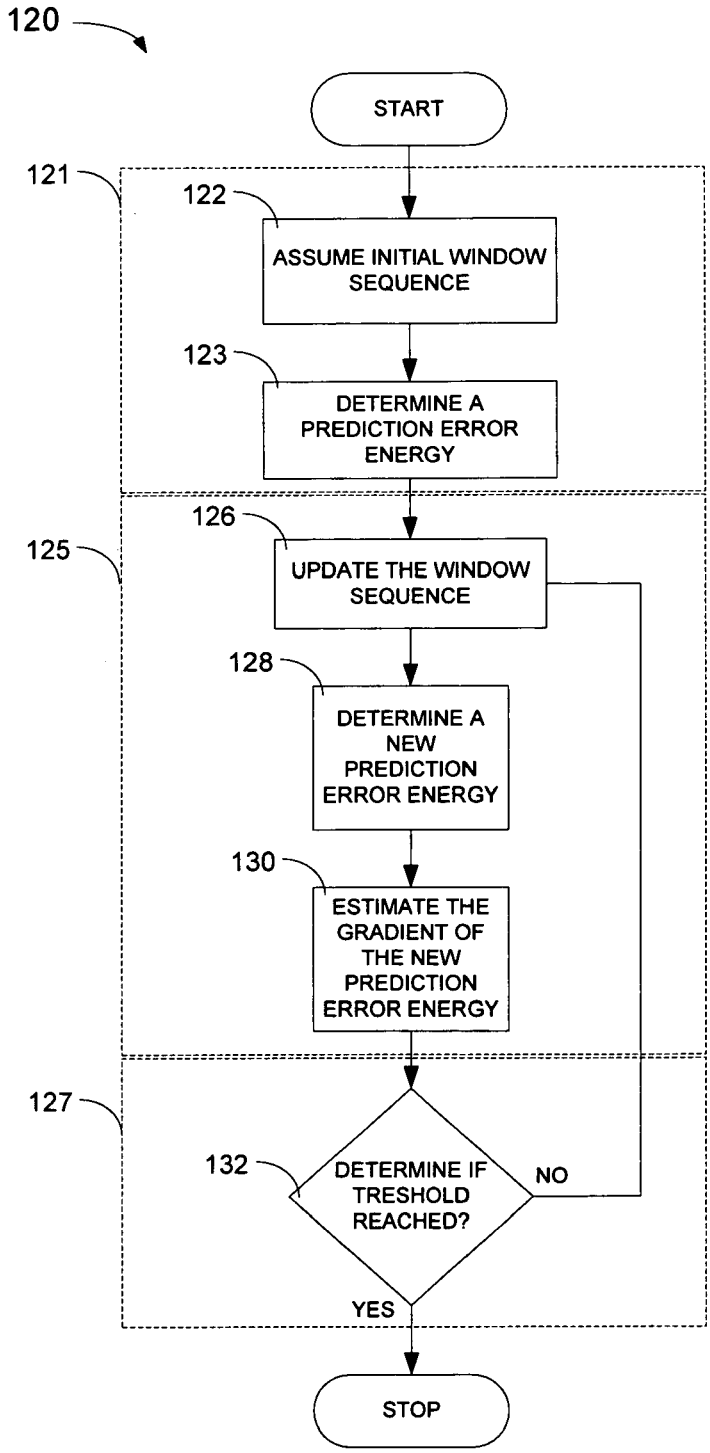
FIG. 6 is a flow chart of an alternate optimization procedure, according to a preferred embodiment of the present invention.

The alternate optimization procedure is shown in FIG. 6 and indicated by reference number 120. The alternate optimization procedure 120 includes an initialization procedure 121, a gradient-descent procedure 125 and a stop procedure 127. The initialization procedure 121 includes assuming an initial window sequence 122, and determining a prediction error energy 123. Assuming an initial window sequence in step 122 generally includes assuming a rectangular window sequence. Determining the prediction error energy in step 123 includes determining the prediction error energy as a function of the speech signal and the initial window sequence using know autocorrelation-based LP analysis methods.

The gradient-descent procedure 125 includes updating the window sequence 126, determining a new prediction error energy 128, and estimating the gradient of the new prediction error energy 130. The window sequence is updated as a function of the perturbation Δw to create a perturbed window sequence w'[n] defined by the equation:

$$w'[n]=w[n],\ n\neq n_o;\ w'[n_o]=w[n_o]+\Delta w,\ n=n_o \tag{22}$$

wherein Δw is known as the window perturbation constant; for which a value is generally assigned prior to implementing the alternate optimization procedure. The concept of the window perturbation constant comes from the basic definition of a partial derivative, given in the following equation:

$$\frac{\partial f(x)}{\partial x}=\lim_{\Delta x\to 0}\frac{f(\Delta x+x)-f(x)}{\Delta x}, \tag{23}$$

According to this definition of a partial derivative, the value of Δw should approach zero, that is, be as low as possible. In practice the value for Δw is selected in such a way that reasonable results can be obtained. For example, the value selected for the window perturbation constant Δw depends, in part, on the degree of numerical accuracy that the underlying system, such as a window optimization device, can handle. In general, a value of $\Delta w=10^{-7}$ to $10^{-4}$ yields satisfactory results, however, the exact value of Δw will depend on the intended application.

The prediction error energy is then determined for the perturbed window sequence (the "new prediction error energy") in step 128. The new prediction error energy is determined as a function of the speech signal and the perturbed window sequence using an autocorrelation method. The autocorrelation method includes relating the new prediction error energy to the autocorrelation values of the speech signal which has been windowed by the perturbed window sequence to obtain a "perturbed autocorrelation values." The perturbed autocorrelation values are defined by the equation:

$$R'[l,n_o]=\sum_{k=1}^{N-1} w'[k,n_o]w'[k-l,n_o]s[k]s[k-l] \tag{24}$$

wherein it is necessary to calculate all Nx(M+1) perturbed autocorrelation values. However, it can easily be shown that, for l=0 to M and $n_o$=0 to N−1:

$$R'[0,n_o]=R[0]+\Delta w(2w[n_o]+\Delta w)s^2[n_o]; \tag{25}$$

and, for l=1 to M:

$$R'[l,n_o]=R[l]+\Delta w(w[n_o-l]s[n_o-l]+w[n_o+l]s[n_o+l])s[n_o]. \tag{26}$$

By using equations (24) and (25) to determine the perturbed autocorrelation values, calculation efficiency is greatly improved because the perturbed autocorrelation values are built upon the results from equation (9) which correspond to the original window sequence.

Estimating the gradient of the new PEEN in step 130 includes determining the partial derivatives of the PEEN with respect to each window sample $\partial J/\partial w[n_o]$. These partial derivatives are estimated using an estimation based on the basic definition of a partial derivative. Assuming that a function f(x) is differentiable:

Using this definition, the partial derivate of $\partial J/\partial w[n_o]$ can be estimated by the following equation:

$$(J'[n_o]-J)/\Delta w. \tag{27}$$

According to equation (26), if the value of Δw is low enough, it is expected that the estimate given in equation (27) is close to the true derivative.

The stop procedure includes determining whether a threshold is met 132, and if the threshold is not met, repeating steps 126 through 132 until the threshold is met. Once the partial derivatives of $\partial J/\partial w[n_o]$ are determined, it is determined whether a threshold has been met. This includes comparing the derivatives of the PEEN obtained for the current window sequence $w_m[n_o]$ with those of the previous window sequence $w_{m-1}[n_o]$. If the difference between $w_m[n_o]$ and $w_{m-1}[n_o]$ is greater than a previously-defined threshold, the threshold has not been met and the gradient-descent procedure 125 and the stop procedure 27 are repeated until the difference between $w_m[n_o]$ and $w_{m-1}[n_o]$ is less than or equal to the threshold.

Implementations and embodiments of the primary and secondary alternate gradient-descent based window optimization algorithms include computer readable software code. These algorithms may be implemented together or independently. Such code may be stored on a processor, a memory device or on any other computer readable storage medium. Alternatively, the software code may be encoded in a computer readable electronic or optical signal. The code may be object code or any other code describing or controlling the functionality described herein. The computer readable storage medium may be a magnetic storage disk such as a floppy disk, an optical disk such as a CD-ROM, semiconductor memory or any other physical object storing program code or associated data.

Several experiments were performed to observe the effectiveness of the primary optimization procedure. All experiments share the same training data set which was created using 54 files from the TIMIT database (see J. Garofolo et al, DARPA TIMIT, Acoustic-Phonetic Continuous Speech Corpus CB-ROM, National Institute of Standards and Technology, 1993.) (downsampled to 8 kHz), and with a total duration of approximately three minutes. To evaluate the capability of the optimized window to work for signals outside the training data set, a testing data set was formed using 6 files not included in the training data set with a total duration of roughly 8.4 second. The prediction order M was always set equal to ten.

In the first experiment, the primary optimization procedure was applied to initial window sequences having window lengths N of 120, 140, 160, 200, 240, and 300 samples. The total number of training epochs m was defined as 100, and the step size parameter was defined as $\mu=10^{-9}$. The initial window was rectangular for all cases. In addition, the analysis interval was made equal to the synthesis interval and equal to the window length of the window sequence.

Figure 7:
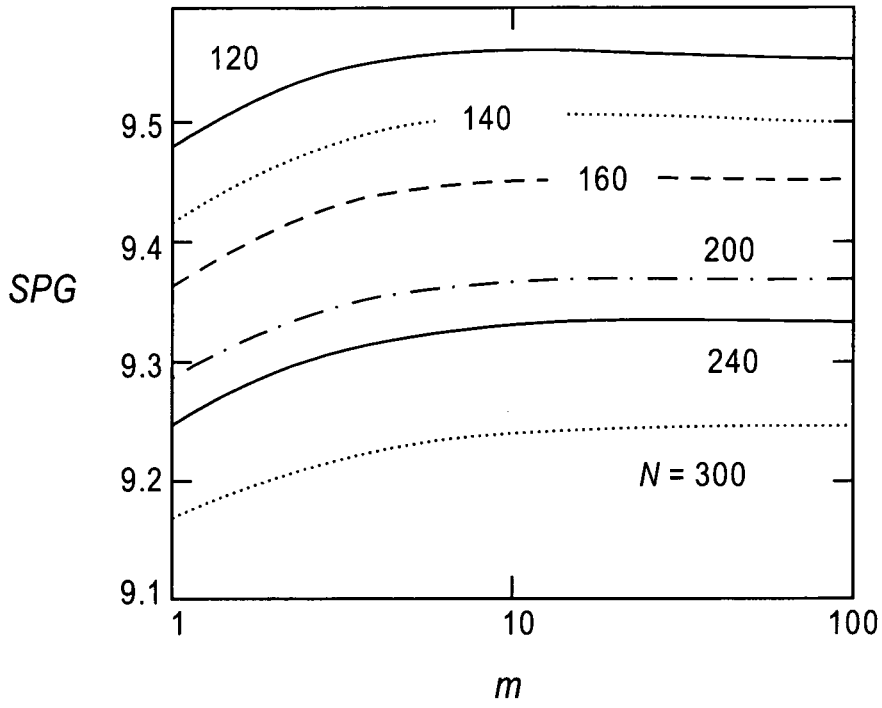
FIG. 7 is a graph of the segmental prediction gain as a function of training epoch for various window sequence lengths, obtained through an experiment according to a preferred embodiment of the present invention.
Figure 8A:
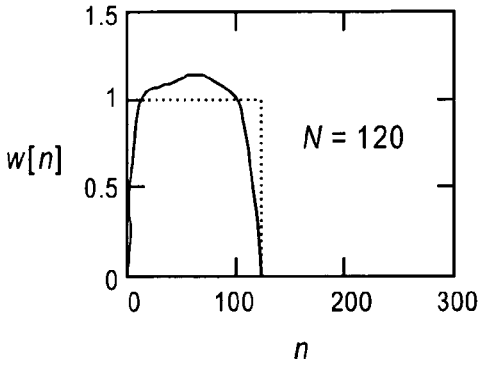
FIG. 8*a* is a graph of the initial and final window sequences for a window length of 120, obtained through an experiment according to a preferred embodiment of the present invention.
Figure 8B:
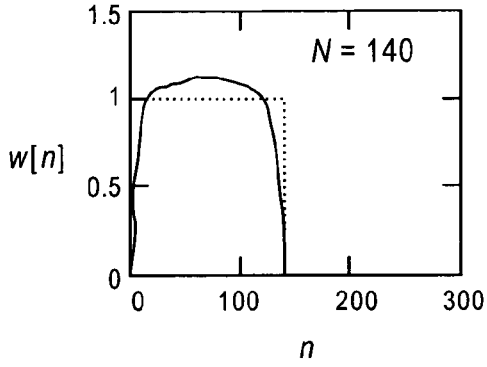
FIG. 8*b* is a graph of the initial and final window sequences for a window length of 140, obtained through an experiment according to a preferred embodiment of the present invention.
Figure 8C:
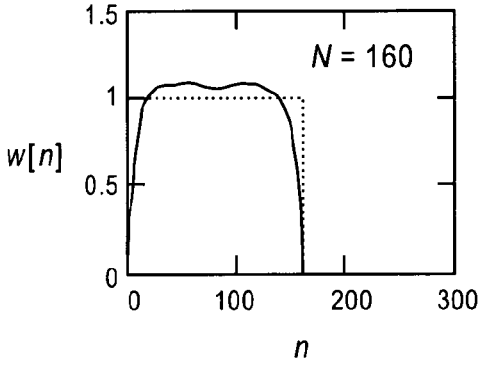
FIG. 8*c* is a graph of the initial and final window sequences for a window length of 160, obtained through an experiment according to a preferred embodiment of the present invention.
Figure 8D:
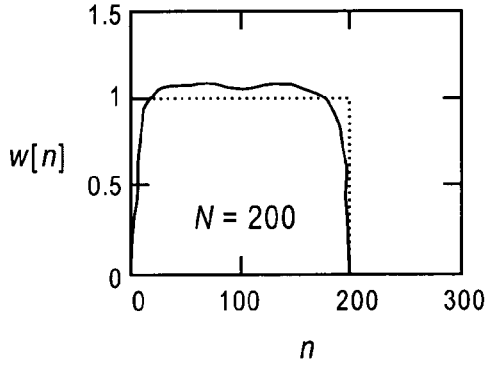
FIG. 8*d* is a graph of the initial and final window sequences for a window length of 200, obtained through an experiment according to a preferred embodiment of the present invention.
Figure 8E:
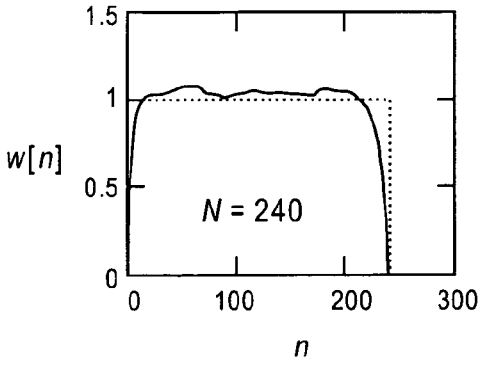
FIG. 8*e* is a graph of the initial and final window sequences for a window length of 240, obtained through an experiment according to a preferred embodiment of the present invention.
Figure 8F:
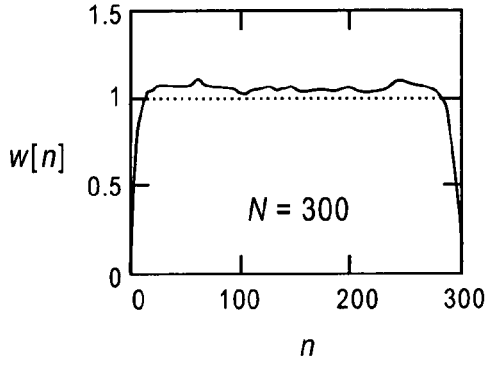
FIG. 8*f* is a graph of the initial and final window sequences for a window length of 300, obtained through an experiment according to a preferred embodiment of the present invention.

FIG. 7 shows the SPG results for the first experiment. The SPG was obtained for windows of various window lengths that were optimized using the primary optimization procedure. The SPG grows as training progresses and tends to saturate after roughly 20 epochs. Performance gain in terms of SPG is usually high at the beginning of the training cycles with gradual lowering and eventual arrival at a local optimum. Moreover, longer windows tend to have lower SPG, which is expected since the same prediction order is applied for all cases, and a lower number of samples are better modeled by the same number of LP coefficients.

FIGS. 8A through 8F show the initial (dashed lines) and optimized (solid lines) windows for the windows of various lengths. Note how all the optimized windows develop a tapered-end appearance, with the middle samples slightly elevated. The table in FIG. 12 summarizes the performance measures before and after optimization, which show substantial improvements in both SPG and PEP. Moreover, these improvements are consistent for both training and testing data set, implying that optimization gain can be generalized for data outside the training set.

A second experiment was performed to determine the effects of the position of the synthesis interval. In this experiment a 240-sample analysis interval with reference coordinate $n \in [0, 239]$ was used. Five different synthesis intervals were considered, including, $I_1=[0, 59]$, $I_2=[60, 119]$, $I_3=[120, 179]$, $I_4=[180, 239]$, and $I_5=[240, 259]$. The first four synthesis intervals are located inside the analysis interval, while the last synthesis interval is located outside the analysis interval. The initial window sequence was a 240-sample rectangular window, and the optimization was performed for 1000 epochs with a step size of $\mu=10^{-9}$.

Figure 9:
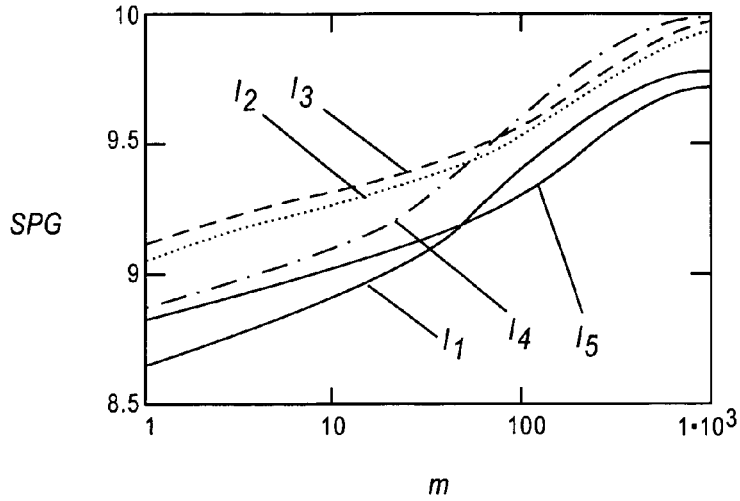
FIG. 9 is a graph of the segmental prediction gain as a function of the training epoch, obtained through an experiment according to a preferred embodiment of the present invention.
Figure 10:
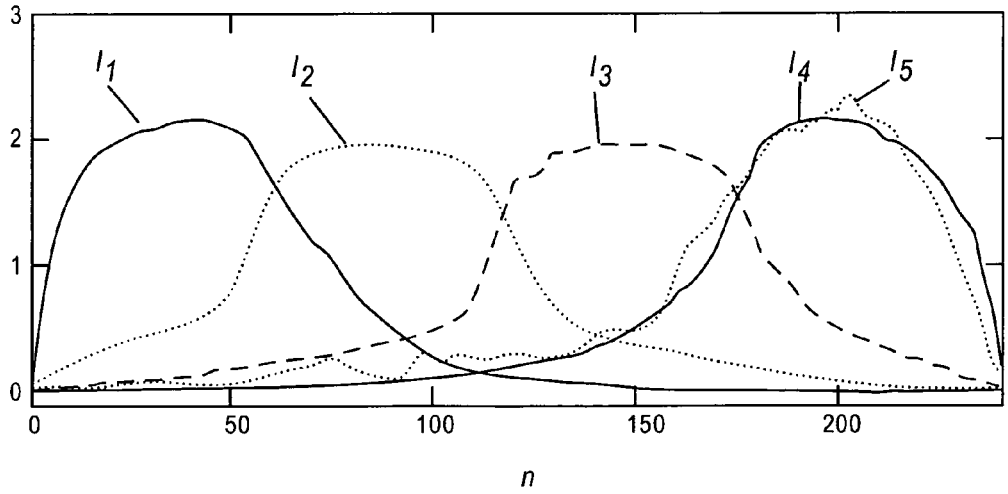
FIG. 10 is a graph of optimized windows, obtained through an experiment according to a preferred embodiment of the present invention.
Figure 11:
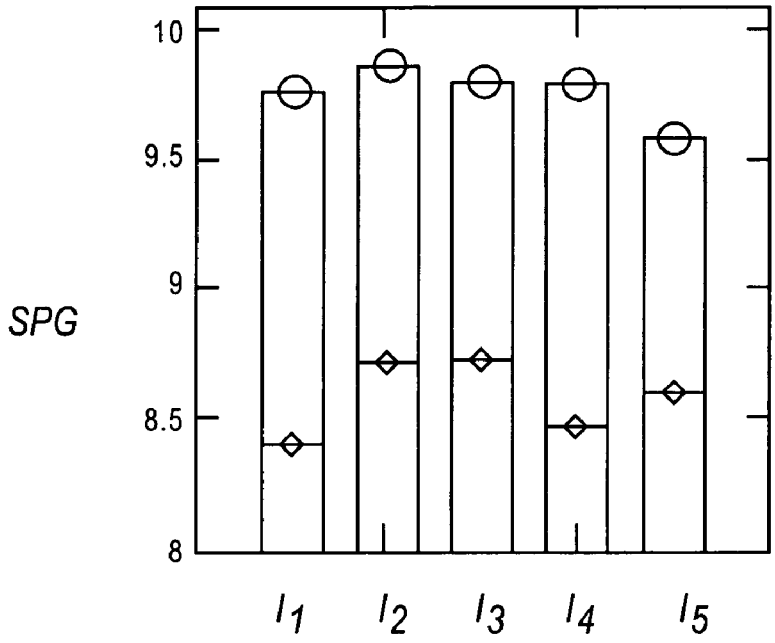
FIG. 11 is a bar graph of the segmental prediction gain before and after the application of an optimization procedure, obtained through an experiment according to a preferred embodiment of the present invention.

FIG. 9 shows the results for the second experiment which include SPG as a function of the training epoch. A substantial increase in performance in terms of the SPG is observed for all cases. The performance increase for $I_1$ to $I_4$ achieved by the optimized window is due to suppression of signals outside the region of interest; while for $I_5$, putting most of the weights near the end of the analysis interval plays an important role. FIG. 10 shows the optimized windows which, as expected, take on a shape that reflects the underlying position of the synthesis interval. The SPG results for the training and testing data sets are shown in FIG. 11, where a significant improvement in SPG over that of the original, rectangular window is obtained. $I_5$ has the lowest SPG after optimization because its synthesis interval was outside the analysis interval.

Figure 13:
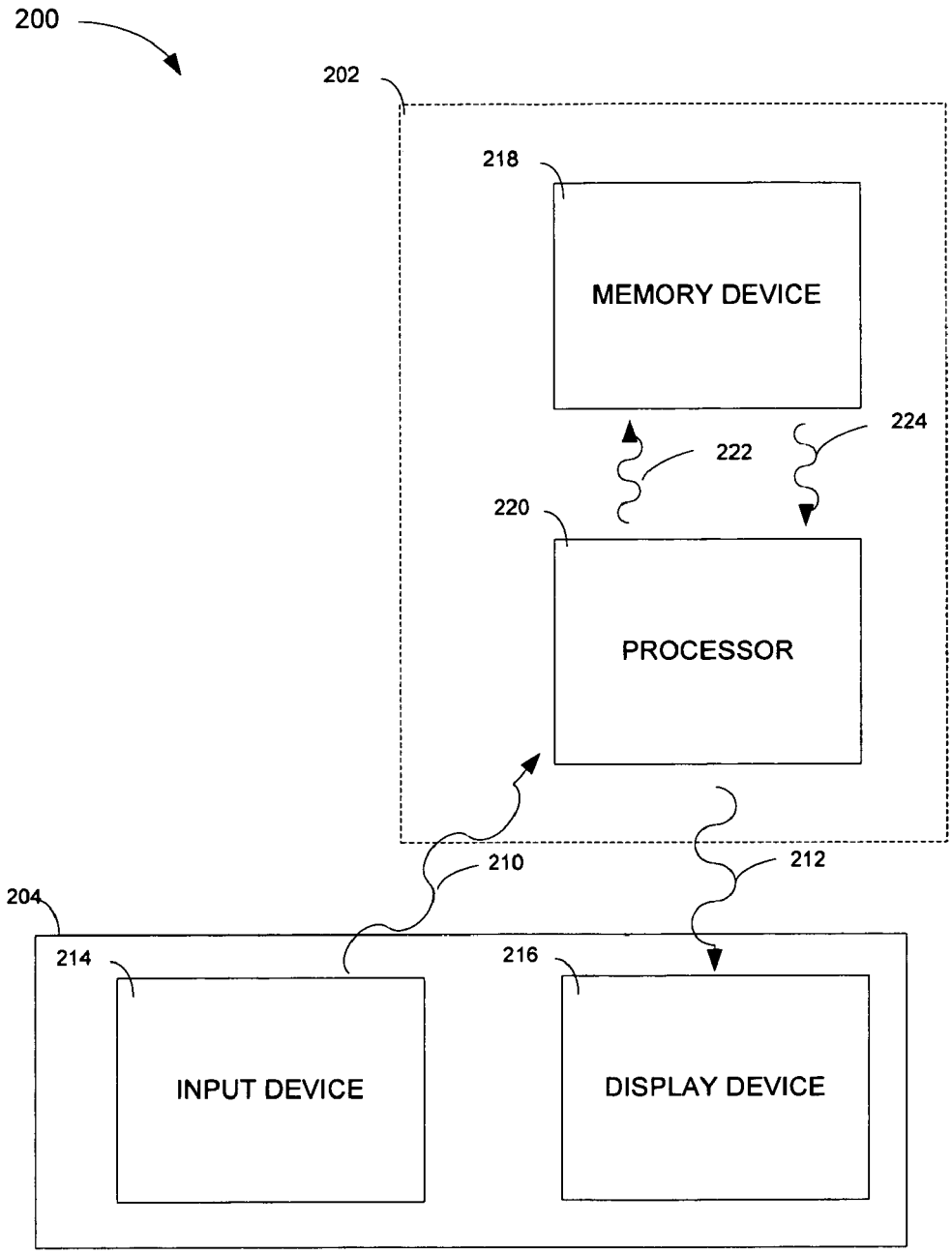
FIG. 13 is a block diagram of a window optimization device.

The window optimization algorithms may be implemented in a window optimization device as shown in FIG. 13 and indicated as reference number 200. The optimization device 200 generally includes a window optimization unit 202 and may also include an interface unit 204. The optimization unit 202 includes a processor 220 coupled to a memory device 216. The memory device 216 may be any type of fixed or removable digital storage device and (if needed) a device for reading the digital storage device including, floppy disks and floppy drives, CD-ROM disks and drives, optical disks and drives, hard-drives, RAM, ROM and other such devices for storing digital information. The processor 220 may be any type of apparatus used to process digital information. The memory device 216 stores, the speech signal, at least one of the window optimization procedures, and the known derivatives of the autocorrelation values. Upon the relevant request from the processor 220 via a processor signal 222, the memory communicates one of the window optimization procedures, the speech signal, and/or the known derivatives of the autocorrelation values via a memory signal 224 to the processor 220. The processor 220 then performs the optimization procedure.

The interface unit 204 generally includes an input device 214 and an output device 216. The output device 216 is any type of visual, manual, audio, electronic or electromagnetic device capable of communicating information from a processor or memory to a person or other processor or memory. Examples of display devices include, but are not limited to, monitors, speakers, liquid crystal displays, networks, buses, and interfaces. The input device 14 is any type of visual, manual, mechanical, audio, electronic, or electromagnetic device capable of communicating information from a person or processor or memory to a processor or memory. Examples of input devices include keyboards, microphones, voice recognition systems, trackballs, mice, networks, buses, and interfaces. Alternatively, the input and output devices 214 and 216, respectively, may be included in a single device such as a touch screen, computer, processor or memory coupled to the processor via a network. The speech signal may be communicated to the memory device 216 from the input device 214 through the processor 220. Additionally, the optimized window may be communicated from the processor 220 to the display device 212.

Although the methods and apparatuses disclosed herein have been described in terms of specific embodiments and applications, persons skilled in the art can, in light of this teaching, generate additional embodiments without exceeding the scope or departing from the spirit of the claimed invention.

I claim:

1. An optimization procedure for optimizing window sequences used in linear prediction analysis, comprising:

an initialization procedure, wherein the initialization procedure assumes an initial window sequence, and defines the initial window sequence as a window sequence;

a gradient-descent procedure, wherein the gradient descent procedure:

determines an updated window sequence, and defines the updated window sequence as the window sequence;

determines a gradient of a prediction error energy wherein the gradient is determined using the window sequence; and a stop procedure, wherein the stop procedure determines if a threshold is met, wherein if the threshold is not met, the gradient-descent procedure and the stop procedure are repeated until the threshold is met.

2. An optimization procedure, as claimed in claim 1, wherein the initialization procedure computes an initial prediction error energy and a derivative of the initial prediction error energy using the initial window sequence and a Levinson-Durbin initialization procedure.

3. An optimization procedure, as claimed in claim 1, wherein the gradient descent procedure determines the gradient of the prediction error energy using the recursion routine of a Levinson-Durbin algorithm.

4. An optimization procedure, as claimed in claim 1, wherein the initialization procedure computes an initial prediction error energy using linear prediction analysis.

5. An optimization procedure, as claimed in claim 1, wherein the gradient descent procedure estimates the gradient of the prediction error energy using an estimate based on a definition of a partial derivative.

6. A method for optimizing a window in linear prediction analysis of a speech signal, comprising:

assuming an initial window sequence, wherein the initial window sequence is a window sequence, wherein the window sequence comprises a plurality of window samples and wherein the length of the window sequence is N;

determining a gradient of a prediction error energy of the speech signal, wherein the speech signal is windowed by the initial window sequence;

updating the window sequence to create a next window sequence, wherein the next window sequence becomes the window sequence;

determining a gradient of a new prediction error energy of the speech signal, wherein the speech signal is windowed by the window sequence; and determining whether a threshold has been reached; wherein if the threshold has not been reached, repeating the steps of updating the window to create the next window sequence, determining the gradient of the prediction error energy of the speech signal windowed by the window sequence, wherein the next window sequence becomes the window sequence, and determining whether the threshold has been reached, until the threshold is reached.

7. A window optimization method, as claimed in claim 6, wherein assuming the initial window sequence comprises assuming a rectangular window sequence.

8. A window optimization method, as claimed in claim 6, wherein determining the gradient of the prediction error energy of the speech signal comprises using a Levinson-Durbin initialization routine.

9. A window optimization method, as claimed in claim 8, wherein determining the gradient of the prediction error energy of the speech signal using a Levinson-Durbin initialization routine comprises:

defining a time lag l, wherein l equals zero;

determining an initial autocorrelation value with respect to each window sample of the initial window R[l], for l=0;

determining a partial derivative of the initial autocorrelation value with respect to each window sample of the initial window sequence, wherein a partial derivative of the initial autocorrelation value with respect to each window sample of the initial window sequence is indicated by $$\frac{\partial R[l]}{\partial w[n]}$$

wherein l=0; and determining a prediction error energy and a partial derivative of the prediction error energy as a function of the initial autocorrelation value with respect to each window sample of the initial window, wherein each of the prediction error energies are indicated by $J_o$ and each of the partial derivatives of the prediction error energy is indicated by $$\frac{\partial J_l}{\partial w[n]}$$

wherein l=0.

10. A window optimization method, as claimed in claim 9, wherein determining R[l] for l=0 comprises determining R[l] for l=0 as a function of the window sequence and the input signal and according to an equation $$R[l] = \sum_{k=1}^{N-1} w[k]s[k]w[k-l]s[k-l] \text{ for } l = 0.$$

11. A window optimization method, as claimed in claim 9, wherein determining $$\frac{\partial R[l]}{\partial w[n]}$$

for l=0 comprises determining $$\frac{\partial R[l]}{\partial w[n]}$$

for l=0 according to known values.

12. A window optimization method, as claimed in claim 6, wherein updating the window sequence comprises defining the next window sequence as a function of a step size parameter.

13. A window optimization method, as claimed in claim 6, wherein determining the gradient of the new prediction error energy of the speech signal comprises using a Levinson-Durbin recursion routine.

14. A window optimization method, as claimed in claim 13, wherein determining the gradient of the new prediction error energy of the speech signal using the Levinson-Durbin recursion routine, comprises:

determining a linear predictive coefficient and a partial derivatives of the linear predictive coefficients for each of the window samples of the window sequence, wherein each of the linear predictive coefficients are indicated by an index i as $a_i$ and each of the partial derivatives of the linear predictive coefficients are indicated by $$\frac{\partial a_i}{\partial w[n]};$$

determining a prediction error sequence as a function of the speech signal windowed by the window sequence and the linear predictive coefficients, wherein the prediction error sequence comprises a new prediction energy estimate for each of the window samples of the window sequence;

determining a partial derivative of the new prediction energy estimate with respect to each of the window samples of the window sequence, wherein the partial derivative of the new prediction energy estimate with respect to each of the window samples of the window sequence is indicated by $$\frac{\partial J}{\partial w[n]}.$$

15. A window optimization method, as claimed in claim 9, wherein determining the linear predictive coefficients and the partial derivatives of the linear predictive coefficients for each of the plurality of window samples of the window sequence comprises using a Levinson-Durbin algorithm.

16. A window optimization method, as claimed in claim 15, wherein using the Levinson-Durbin algorithm comprises:

incrementing the time lag l, by defining l according to an equation l=l+1;

determining an l-order autocorrelation value with respect to each of the plurality of window samples of the window, wherein each of the l-order autocorrelation values is indicated by R[l];

determining a partial derivative of each of the l-order autocorrelation values with respect to each of the window samples of the window sequence, wherein each of the l-order autocorrelation values is indicated by $$\frac{\partial R[l]}{\partial w[n]};$$

calculating the linear predictive coefficients and the partial derivative of each of the linear predictive coefficients with respect to each of the window samples of the window sequence, wherein each of the linear predictive coefficients are indicated by an index i as $a_i$ and each of the partial derivatives of the linear predictive coefficients are indicated by $$\frac{\partial a_i}{\partial w[n]};$$

and determining if l equals an order M, wherein if l does not equal the order M, repeating the steps of incrementing the time lag l by defining l according to an equation l=l+1; determining R[l]; determining $$\frac{\partial R[l]}{\partial w[n]};$$

calculating the linear predictive coefficients and the partial derivatives of the linear predictive coefficients with respect to each of the window samples of the window sequence; and determining if l equals an order M until l equals an order M.

17. A window optimization method, as claimed in claim 16, wherein determining R[l] comprises determining R[l] as a function of a plurality of indices k, the window length N, the plurality of speech signal samples s[k], and the plurality of window samples w[k] of the window sequence, wherein R[l] is defined by an equation $$R[l] = \sum_{k=l}^{N-1} w[k]s[k]w[k-l]s[k-l].$$

18. A window optimization method, as claimed in claim 16, wherein determining $$\frac{\partial R[l]}{\partial w[n]}$$

comprises determining $$\frac{\partial R[l]}{\partial w[n]}$$

according to known values.

19. A window optimization method, as claimed in claim 16, wherein calculating $a_i$ and $$\frac{\partial R[l]}{\partial w[n]}$$

comprises:

determining a reflection coefficient for each of the window samples of the window sequences and a partial derivative of each of the reflection coefficients for each of the window samples of the window sequences, wherein each of the reflection coefficients are indicated by $k_l$ and the partial derivative of each of the reflection coefficients is indicated by $$\frac{\partial k_l}{\partial w[n]};$$

determining at least two update functions for each window sample of the window sequence and a partial derivative of each of the at least two update functions for each window sample of the window sequence, wherein the at least two update functions are indicated by $a_i^{(l)}=-k_l$ and $a_i^{(l)}=a_i^{(l-1)}-k_l a_{l-i}^{(l-1)}$ and the partial derivative of each of the at least two update functions is indicated by $$\frac{\partial a_i^{(l)}}{\partial w[n]} = \frac{\partial k_l}{\partial w[n]}$$

and $$\frac{\partial a_i^{(l)}}{\partial w[n]} = \frac{\partial a_i^{(l-1)}}{\partial w[n]} - a_{l-i}^{(l-1)} \frac{\partial k_l}{\partial w[n]} - k_l \frac{\partial a_{l-i}^{(l-1)}}{\partial w[n]};$$

determining an l-order partial derivative of the linear predictive coefficients with respect to each window sample of the window sequence; and determining if l equals M, wherein if l does not equal M, updating the l-order prediction error energy and the partial derivative of the prediction error energy, wherein the prediction error energy is indicated by $J_l$ and the partial derivative of the prediction error energy is indicated by $$\frac{\partial J_l}{\partial w[n]},$$

and repeating determining the at least two update functions and the partial derivative of each of the at least two update functions, for each window sample of the window sequence and determining if l equals M until l equals M; wherein when l equals M, defining the linear predictive coefficients according to an equation $a_i = a_i^{(M)}$ and defining the partial derivative of the linear predictive coefficients according to an equation $$\frac{\partial a_i}{\partial w[n]} = \frac{\partial a_i^{(M)}}{\partial w[n]}$$

for each window sample of the window sequence.

20. A window optimization method, as claimed in claim 16, wherein determining the partial derivative of each of the reflection coefficients $k_l$ with respect to each of the window samples of the window sequence comprises defining the partial derivative of each of the reflection coefficients $k_l$ with an equation $$\frac{\partial k_l}{\partial w[n]} = \frac{1}{J_{l-1}}\left(\frac{\partial R[l]}{\partial w[n]} - \frac{R[l]}{J_{l-1}}\frac{\partial J_{l-1}}{\partial w[n]} + \sum_{i=1}^{l-1} a_i^{(l-1)} \frac{\partial R}{\partial w[n]} + R[l-i]\frac{\partial a_i^{(l-1)}}{\partial w[n]} - \frac{a_i^{(l-1)} R[l-i]}{J_{l-1}}\frac{\partial J_{l-1}}{\partial w[n]}\right).$$

21. A window optimization method, as claimed in claim 16, wherein defining the l-order partial derivative of the linear prediction coefficients comprises defining the l-order partial derivative of the linear prediction coefficients according to an equation, $$\frac{\partial a_i^{(l)}}{\partial w[n]} = \frac{\partial a_i^{(l-1)}}{\partial w[n]} - a_{l-i}^{(l-1)} \frac{\partial k_l}{\partial w[n]} = k_l \frac{\partial a_{l-i}^{(l-1)}}{\partial w[n]},$$

for i=1, 2, . . . l−1.

22. A window optimization method, as claimed in claim 19, wherein updating the l-order prediction error energy and the partial derivative of the prediction error energy further comprises:

updating $J_l$, wherein $J_l$ is updated according to an equation $J_l = J_l - 1(1 - k_l^2)$; and updating $$\frac{\partial J_l}{\partial w[n]},$$

wherein $$\frac{\partial J_l}{\partial w[n]}$$

is updated according to an equation $$\frac{\partial J_l}{\partial w[n]} = (1 - k_1^2)\frac{\partial J_{l-1}}{\partial w[n]} - 2k_l J_{l-1} \frac{\partial k_l}{\partial w[n]}.$$

23. A window optimization method, as claimed in claim 14, wherein, determining the prediction error sequence as a function of the speech signal windowed by the window sequence and the linear predictive coefficients, comprises: determining the prediction error sequence e[n] over a synthesis interval n wherein n $\epsilon[n_1, n_2]$, as defined by an equation, $$\sum_{n=n_1}^{n_2} (e[n]) = \sum_{n=n_1}^{n_2} \left(s[n] + \sum_{i=1}^{M} a_i s[n-i]\right)\Bigg].$$

24. A window optimization method, as claimed in claim 14, wherein, calculating $$\frac{\partial J}{\partial w[n]}$$

comprises, evaluating an equation for each of the window samples within the synthesis window $$\frac{\partial J}{\partial w[n]} = \sum_{k=n_1}^{n_2} 2e[k]\frac{\partial e[k]}{\partial w[n]} = \sum_{k=n_1}^{n_2} 2e[k]\left(\sum_{i=1}^{M} S[k-i]\frac{\partial a_i}{\partial w[n]}\right);$$

and defining the gradient by an equation $$\nabla J = \left[\frac{\partial J}{\partial w[0]}\ \frac{\partial J}{\partial w[1]} \cdots \frac{\partial J}{\partial w[N-1]}\right]^T.$$

25. A method for optimizing a window in linear prediction analysis of a speech signal, comprising:

assuming a rectangular initial window sequence, wherein the rectangular initial window sequence is a window sequence, wherein the window sequence comprises a plurality of window samples and wherein the length of the window sequence is N;

determining a gradient of a prediction error energy of the speech signal, wherein the speech signal is windowed by the rectangular initial window sequence, using a Levinson-Durbin initialization routine comprising:

defining a time lag l, wherein 1 equals zero;

determining an initial autocorrelation value with respect to each window sample of the rectangular initial window R[l], for l=0;

determining a partial derivative of the initial autocorrelation value with respect to each window sample of the rectangular initial window sequence, wherein a partial derivative of the initial autocorrelation value with respect to each window sample of the initial window sequence is indicated by $$\frac{\partial R[l]}{\partial w[n]}$$

wherein l=0, and wherein determining R[l] for l=0 comprises determining R[l], for l=0 according to known values for l=0; and determining a prediction error energy and a partial derivative of the prediction error energy as a function of the initial autocorrelation value with respect to each window sample of the rectangular initial window, wherein each of the prediction error energies are indicated by $J_o$ and each of the partial derivatives of the prediction error energy is indicated by $$\frac{\partial J_l}{\partial w[n]}$$

wherein l=0;

updating the window sequence to create a next window sequence by defining the next window sequence as a function of a step size parameter, wherein the next window sequence becomes the window sequence;

determining a gradient of a new prediction error energy of the speech signal, wherein the speech signal is windowed by the window sequence; wherein determining a gradient of a new prediction error energy of the speech signal comprises using a Levinson-Durbin recursion routine, wherein using a Levinson-Durbin recursion routine comprises:

determining a linear predictive coefficient and a partial derivative of the linear predictive coefficients for each of the window samples of the window sequence, wherein each of the linear predictive coefficients is indicated by an index i as $a_i$ and each of the partial derivatives of the linear predictive coefficients are indicated by $$\frac{\partial a_i}{\partial w[n]},$$

wherein determining the linear predictive coefficient and the partial derivative of the linear predictive coefficients for each of the window samples of the window sequence comprises using a Levinson-Durbin algorithm, wherein using a Levinson-Durbin algorithm comprises:

incrementing the time lag l, by defining l according to an equation l=l+1;

determining an l-order autocorrelation value with respect to each of the plurality of window samples of the window, wherein each of the l-order autocorrelation values is indicated by R[l], wherein determining R[l] comprises determining R[l] as a function of a plurality of indices k, the window length N, the plurality of speech signal samples s[k], and the plurality of window samples w[k] of the window sequence, wherein R[l] is defined by an equation $$R[l] = \sum_{k=l}^{N-1} w[k]s[k]w[k-l]s[k-l];$$

determining a partial derivative of each of the l-order autocorrelation values with respect to each of the window samples of the window sequence, wherein each of the l-order autocorrelation values is indicated by $$\frac{\partial R[l]}{\partial w[n]},$$

wherein determining $$\frac{\partial R[l]}{\partial w[n]}$$

comprises determining $$\frac{\partial R[l]}{\partial w[n]}$$

according to known values;

calculating the linear predictive coefficients and the partial derivative of each of the linear predictive coefficients with respect to each of the window samples of the window sequence, wherein each of the linear predictive coefficients are indicated by an index i as $a_i$ and each of the partial derivatives of the linear predictive coefficients are indicated by $$\frac{\partial a_i}{\partial w[n]},$$

wherein calculating $a_i$ and $$\frac{\partial a_i}{\partial w[n]}$$

comprises:

determining a reflection coefficient for each of the window samples of the window sequences and a partial derivative of each of the reflection coefficients for each of the window samples of the window sequences, wherein each of the reflection coefficients are indicated by $k_l$ and the partial derivative of each of the reflection coefficients is indicated by $$\frac{\partial k_l}{\partial w[n]};$$

determining at least two update functions for each window sample of the window sequence and a partial derivative of each of the at least two update functions for each window sample of the window sequence, wherein the at least two update functions are indicated by $a_i^{(l)}=-kl$ and $a_i^{(l)}=a_i^{(l-1)}-kla_{l-i}^{(l-1)}$ and the partial derivative of each of the at least two update functions is indicated by $$\frac{\partial a_i^{(l)}}{\partial w[n]} = -\frac{\partial k_l}{\partial w[n]} \text{ and}$$

$$\frac{\partial a_i^{(l)}}{\partial w[n]} = \frac{\partial a_i^{(l-1)}}{\partial w[n]} - a_{l-i}^{(l-1)}\frac{\partial k_l}{\partial w[n]} - k_l\frac{\partial a_{l-i}^{(l-1)}}{\partial w[n]};$$

determining an l-order partial derivative of the linear predictive coefficients with respect to each window sample of the window sequence; and determining if l equals M, wherein if l does not equal M, updating the l-order prediction error energy and the partial derivative of the prediction error energy, wherein the prediction error energy is indicated by $J_l$ and the partial derivative of the prediction error energy is indicated by $$\frac{\partial J_l}{\partial w[n]}$$

and repeating determining the at least two update functions and the partial derivative of each of the at least two update functions, for each window sample of the window sequence and determining if l equals M until l equals M; wherein when l equals M, defining the linear predictive coefficients according to an equation $a_i=a_i^{(M)}$ and defining the partial derivative of the linear predictive coefficients according to an equation $$\frac{\partial a_i}{\partial w[n]} = \frac{\partial a_i^{(M)}}{\partial w[n]}$$

for each window sample of the window sequence;

determining if l equals an order M, wherein if l does not equal the order M, repeating the steps of incrementing the time lag l by defining l according to an equation l=l+1; determining R[l]; determining $$\frac{\partial R[l]}{\partial w[n]};$$

calculating the linear predictive coefficients and the partial derivatives of the linear predictive coefficients with respect to each of the window samples of the window sequence; and determining if l equals an order M until l equals an order M;

determining a prediction error sequence as a function of the speech signal windowed by the window sequence and the linear predictive coefficients, wherein the prediction error sequence comprises a new prediction energy estimate for each of the window samples of the window sequence, wherein determining the prediction error sequence as a function of the speech signal windowed by the window sequence and the linear predictive coefficients, comprises: determining the prediction error sequence e[n] over a synthesis interval n wherein $n \in [n_1, n_2]$, as defined by an equation, $$\sum_{n=n_1}^{n_2} (e[n]) = \sum_{n=n_1}^{n_2} \left( s[n] + \sum_{i=1}^{M} a_i s[n-i] \right);$$

determining a partial derivative of the new prediction energy estimate with respect to each of the window samples of the window sequence, wherein the partial derivative of the new prediction energy estimate with respect to each of the window samples of the window sequence is indicated by $$\frac{\partial J}{\partial w[n]},$$

wherein, calculating $$\frac{\partial J}{\partial w[n]}$$

comprises, evaluating an equation for each of the window samples within the synthesis window $$\frac{\partial J}{\partial w[n]} = \sum_{k=n_1}^{n_2} 2e[k]\frac{\partial e[k]}{\partial w[n]} = \sum_{k=n_1}^{n_2} 2e[k]\left(\sum_{i=1}^{M} s[k-i]\frac{\partial a_i}{\partial w[n]}\right);$$

and defining the gradient by an equation $$\nabla J = \left[\frac{\partial J}{\partial w[0]} \quad \frac{\partial J}{\partial w[1]} \cdots \frac{\partial J}{\partial w[N-1]}\right];$$

and determining whether a threshold has been reached; wherein if the threshold has not been reached, repeating the steps of updating the window to create the next window sequence, determining the gradient of the prediction error energy of the speech signal windowed by the window sequence wherein the next window sequence becomes the window sequence, and determining whether the threshold has been reached, until the threshold is reached.

26. A method for optimizing a window in linear prediction analysis of a speech signal, comprising:

assuming an initial window sequence, wherein the initial window sequence is a window sequence, wherein the initial window sequence comprises a plurality of window samples, wherein each of the plurality of window samples of the initial window sequence is indicated by w[n], and wherein the length of the window sequence is N;

determining a prediction error energy as a function of the speech signal windowed by the initial window sequence;

updating the window sequence comprising, creating a perturbed window sequence as a function of a window perturbation constant, wherein the perturbed window sequence becomes the window sequence and the window sequence comprises a plurality of window samples, wherein each of the plurality of window samples of the perturbed window sequence is indicated by w'[n];

determining a new prediction error energy as a function of the speech signal windowed by the perturbed window sequence;

estimating a gradient of the new prediction error energy as a function of the speech signal windowed by the perturbed window sequence; and determining whether a threshold has been reached; wherein if the threshold has not been reached, repeating the steps of updating the window sequence comprising, creating the next window sequence as the function of the window perturbation constant, wherein the perturbed window sequence becomes the window sequence; determining the new prediction error energy as the function of the speech signal windowed by the window sequence; estimating the gradient of the prediction error energy as the function of the speech signal windowed by the window sequence, and determining whether the threshold has been reached, until the threshold is reached.

27. A window optimization method, as claimed in claim 26, wherein assuming the initial window sequence comprises assuming a rectangular window sequence.

28. A window optimization method, as claimed in claim 26, wherein determining the prediction error energy as the function of the speech signal windowed by the initial window sequence comprises using an autocorrelation method.

29. A window optimization method, as claimed in claim 26, wherein creating the perturbed window sequence as the function of the window perturbation constant, wherein the window perturbation constant is indicated by $\Delta w$, comprises defining the perturbed window sequence according to a set of relationships comprising, $w'[n]=w[n]$, $n \neq n_o$; $w'[n_o]=w[n_o]+\Delta w$.

30. A window optimization method, as claimed in claim 29, wherein the window perturbation constant has a value of approximately $10^{-7}$ to approximately $10^{-4}$.

31. A window optimization method, as claimed in claim 26, wherein determining the new prediction error as a function of the speech signal windowed by the perturbed window sequence comprises, using an autocorrelation method.

32. A window optimization method, as claimed in claim 31, wherein using the autocorrelation method comprises relating the new prediction error energy, wherein the new prediction error energy is indicated by $J'[n_o]$, to perturbed autocorrelation values, wherein the perturbed autocorrelation values are indicated by $R'[l, n_o]$, are a function of a time-lag l and sample $n_o$, according to a first equation $J'[n_o]=R'[0, n_o]$, $R[0]+\Delta w\ (2w[n_o]+\Delta w)s^2[n_o]$ for $l=0$ to a prediction order M and $n_o=0$ to $N-1$, and according to a second equation $J'[n_o]=R'[l, n_o]=R[l]+\Delta w\ (w[n_o-1]s[n_o-1]+w[n_o+1]s[n_o+1]s[n_o]$ for $l=0$ to M and $n_o=0$ to $N-1$.

33. A window optimization method, as claimed in claim 26, wherein estimating the gradient of the new prediction error energy as a function of the speech signal and the perturbed window sequence comprises, estimating the partial derivative of the new prediction error energy with respect to the window sequence for each of the window samples $w'[n_o]$, wherein the partial derivative of the new prediction error energy with respect to the window sequence for each of the window samples is indicated by $\partial J'|\partial w[n_o]$.

34. A window optimization method, as claimed in claim 33, wherein estimating the partial derivative of the new prediction error energy $\partial J'|\partial w[n_o]$ comprises, using an estimate based on a basic definition of a partial derivative.

35. A window optimization method, as claimed in claim 34, wherein the basic definition of a derivative is defined by a function f(x), a variable x, an incremental change in the variable $\Delta x$, and by a relationship:

$$\frac{\partial f(x)}{\partial x} = \lim_{\Delta x \to 0} \frac{f(\Delta x + x) - f(x)}{\Delta x}.$$

36. A window optimization method, as claimed in claim 33, wherein estimating the partial derivative of the new prediction error energy, wherein the partial derivative of the new prediction error energy is indicated by $\partial J'|\partial w[n_o]$, comprises, defining the partial derivative of the prediction error energy for each window sample of the window sequence according to an equation $(J'[n_o]-J)/\Delta w$.

37. A method for optimizing a window in linear prediction analysis of a speech signal, comprising:

assuming a rectangular initial window sequence, wherein the rectangular initial window sequence is a window sequence, wherein the rectangular initial window sequence comprises a plurality of window samples, wherein each of the plurality of window samples of the initial window sequence is indicated by w[n], and wherein the length of the window sequence is N;

determining a prediction error energy as a function of the speech signal windowed by the initial window sequence using an autocorrelation method;

updating the window sequence comprising, creating a perturbed window sequence as a function of a window perturbation constant, wherein the perturbed window sequence becomes the window sequence and the window sequence comprises a plurality of window samples, wherein each of the plurality of window samples of the perturbed window sequence is indicated by w'[n], and wherein creating the perturbed window sequence as the function of the window perturbation constant, wherein the window perturbation constant is indicated by $\Delta w$, comprises defining the perturbed window sequence according to a set of relationships comprising, $w'[n]=w[n]$, $n \neq n_o$; $w'[n_o]=w[n_o]+\Delta w$;

determining a new prediction error energy as a function of the speech signal windowed by the perturbed window sequence using an autocorrelation method, wherein using the autocorrelation method comprises relating the new prediction error energy, wherein the new prediction error energy is indicated by $J'[n_o]$, to perturbed autocorrelation values, wherein the perturbed autocorrelation values are indicated by $R'[l, n_o]$, are a function of a time-lag l and sample $n_o$, according to a first equation $J'[n_o]=R'[0, n_o]=R[0]+\Delta w(2w[n_o]+\Delta w)\, s^2[n_o]$ for $l=0$ to a prediction order M and $n_o=0$ to $N-1$, and according to a second equation $J'[n_o]=R'[l, n_o]=R[l]+\Delta w\,(w[n_o-1]s[n_o-l]+w[n_o+l]s[n_o+l])s[n_o]$ for $l=0$ to M and $n_o=0$ to $N-1$;

estimating a gradient of the new prediction error energy as a function of the speech signal windowed by the perturbed window sequence comprising, estimating the partial derivative of the new prediction error energy with respect to the window sequence for each of the window samples $w'[n_o]$, wherein the partial derivative of the new prediction error energy is indicated by $\partial J'/\partial w[n_o]$, comprises, defining the partial derivative of the prediction error energy for each window sample of the window sequence according to an equation $(J'[n_o]-J)/\Delta w$; and determining whether a threshold has been reached; wherein if the threshold has not been reached, repeating the steps of updating the window sequence comprising, creating the next window sequence as the function of the window perturbation constant, wherein the perturbed window sequence becomes the window sequence; determining the new prediction error energy as the function of the speech signal windowed by the window sequence; estimating the gradient of the prediction error energy as the function of the speech signal windowed by the window sequence, and determining whether the threshold has been reached, until the threshold is reached.

38. A computer readable storage medium storing computer readable program code for producing an optimized window for analysis of a speech signal, the computer readable program code comprising:

data encoding the speech signal;

a computer code implementing a gradient-descent based window optimization procedure in response to an input of an initial window, wherein the gradient-descent based window optimization procedure optimizes the initial window so as to minimize a prediction error energy by calculating a gradient of the prediction error energy.

39. A computer readable storage medium storing computer readable program code for producing an optimized window for analysis of a speech signal, the computer readable program code comprising:

data encoding the speech signal;

a computer code implementing a gradient-descent based window optimization procedure in response to an input of an initial window, wherein the gradient-descent based window optimization procedure optimizes the initial window so as to maximize a segmental prediction gain by calculating a gradient of a segmental prediction gain.

40. A computer readable storage medium storing computer readable program code for producing an optimized window for analysis of a speech signal, the computer readable program code comprising:

data encoding the speech signal;

a computer code implementing a gradient-descent based window optimization procedure in response to an input of an initial window, wherein the gradient-descent based window optimization procedure optimizes the initial window so as to minimize a prediction error energy by estimating a gradient of the prediction error energy.

41. A computer readable storage medium storing computer readable program code for producing an optimized window for analysis of a speech signal, the computer readable program code comprising:

data encoding the speech signal;

a computer code implementing a gradient-descent based window optimization procedure in response to an input of an initial window, wherein the gradient-descent based window optimization procedure optimizes the initial window so as to maximize a segmental prediction gain by estimating a gradient of a segmental prediction gain.

42. A window optimization device, comprising:

a memory device, wherein the memory device stores a speech signal, at least one gradient-descent based window optimization procedure and known derivatives of autocorrelation values;

a processor coupled to the memory device, wherein the processor optimizes a window for linear predictive analysis of the speech signal using the speech signal, the at least one window optimization procedure and the known derivatives of the autocorrelation values communicated by the memory device.

43. A window optimization device, comprising:

a memory device, wherein the memory device stores a speech signal, at least one gradient-descent based window optimization procedure and known derivatives of autocorrelation values;

wherein the at least one window gradient-descent based optimization procedure determines a gradient of a prediction error energy using a Levinson-Durbin based algorithm, wherein the Levinson-Durbin based algorithm is stored in the memory device and communicated to the processor; and a processor coupled to the memory device, wherein the processor optimizes a window for linear predictive analysis of the speech signal using the speech signal, the at least one window optimization procedure and the known derivatives of the autocorrelation values communicated by the memory device.

44. A window optimization device, comprising:

a memory device, wherein the memory device stores a speech signal, at least one gradient-descent based window optimization procedure and known derivatives of autocorrelation values;

wherein the at least one window gradient-descent based optimization procedure determines a gradient of a prediction error energy using an estimate based on a basic definition of a partial derivative, wherein the estimate based on a basic definition of a partial derivative is stored in the memory device and communicated to the processor; and a processor coupled to the memory device, wherein the processor optimizes a window for linear predictive analysis of the speech signal using the speech signal, the at least one window optimization procedure and the known derivatives of the autocorrelation values communicated by the memory device.

* * * * *